US010285546B2

(12) United States Patent
Edwards

(10) Patent No.: US 10,285,546 B2
(45) Date of Patent: May 14, 2019

(54) SYSTEM AND METHOD FOR REMOVABLY MOUNTING TOILET SEAT TO TOILET BOWL

(71) Applicant: Topseat International, Inc., Plano, TX (US)

(72) Inventor: Merle Edwards, Sheboygan Falls, WI (US)

(73) Assignee: Topseat International, Inc., Plano, TX (US)

( * ) Notice: Subject to any disclaimer, the term of this patent is extended or adjusted under 35 U.S.C. 154(b) by 0 days.

(21) Appl. No.: 15/431,106

(22) Filed: Feb. 13, 2017

(65) Prior Publication Data

US 2018/0228325 A1 Aug. 16, 2018

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
See application file for complete search history.

(56) References Cited

U.S. PATENT DOCUMENTS 1,799,309 A * 4/1931 Mears ..... A47K 13/12 16/365
3,561,317 A 2/1971 Rowell
3,568,221 A 3/1971 Haldopoulos
3,699,614 A 10/1972 Stairs
3,742,583 A 7/1973 Devlin et al.
4,011,786 A 3/1977 Liebig
4,015,505 A 4/1977 Murray
4,029,379 A 6/1977 Kotala et al.
4,080,671 A 3/1978 Stahli
4,087,884 A 5/1978 Seiderman
4,148,104 A 4/1979 Ginsburg
4,159,548 A 7/1979 Hewson
4,290,337 A 9/1981 Kuwata et al.
4,293,259 A 10/1981 Liebig
4,314,382 A 2/1982 Ginsburg et al.
4,319,365 A 3/1982 Bemis et al.
4,326,307 A 4/1982 Baillie et al.
4,391,001 A 7/1983 Harrison
4,398,307 A 8/1983 Ginsburg et al.
4,416,048 A * 11/1983 Otte ..... A47K 13/26 29/525.04

(Continued)

FOREIGN PATENT DOCUMENTS

EP 2997868 B1 12/2016
WO WO2014032372 A1 3/2014

*Primary Examiner* — J C Jacyna

(57) ABSTRACT

A hinge assembly for a toilet seat includes a mounting base, a hinge leaf assembly, a threaded bolt, a threaded nut, a washer, and an expanding dowel. The hinge leaf assembly includes hinge leaves configured to attach to a toilet seat and a toilet lid. The threaded bolt configured is to attach the mounting base to a flange portion of a toilet bowl, the bolt having a bolt head at one end. The threaded nut has a sloped surface and is configured to screw onto the bolt. The washer has a sloped surface and is configured to surround the bolt between the bolt head and the nut. The expanding dowel is configured to expand outward and is further configured to surround the bolt between the washer and the nut.

20 Claims, 16 Drawing Sheets

(56) References Cited

U.S. PATENT DOCUMENTS 4,467,481 A 8/1984 Ginsburg
4,514,356 A 4/1985 Harrison
4,659,267 A 4/1987 Uno et al.
4,729,703 A 3/1988 Sato
4,819,522 A 4/1989 Stinson
4,878,255 A 11/1989 Grimstad et al.
4,921,381 A 5/1990 Gschwend et al.
4,965,889 A 10/1990 Tissot et al.
5,010,601 A 4/1991 Kobayashi et al.
5,108,238 A 4/1992 Ewing
5,314,277 A 5/1994 Fischer
5,933,875 A 8/1999 Hulsebus et al.
6,012,886 A * 1/2000 Tanamura ..... A47K 13/26 4/236
6,026,520 A 2/2000 Pedersen
6,070,295 A 6/2000 Hulsebus
6,234,734 B1 5/2001 Klippel
6,381,762 B1 5/2002 Moser
6,763,529 B1 * 7/2004 Richter ..... A47K 13/26 4/236
6,807,686 B1 10/2004 Janes
6,931,672 B1 8/2005 Richter
7,155,748 B2 1/2007 Vierkant, III et al.
7,203,975 B2 4/2007 Vierkant, III
7,204,667 B2 4/2007 Uno et al.
7,281,276 B2 10/2007 Vierkant, III et al.
7,389,549 B2 6/2008 Vierkant, III
7,566,195 B2 7/2009 Hull
7,712,157 B2 5/2010 Laundre
7,827,626 B2 11/2010 Zhou
7,845,027 B2 12/2010 Er et al.
7,857,563 B2 12/2010 Pratt
7,891,924 B2 2/2011 Mercer et al.
7,896,598 B2 3/2011 Mercer et al.
8,087,103 B2 1/2012 Leibfried
8,118,526 B2 2/2012 Dowling
8,763,168 B2 7/2014 Zhou
9,095,241 B1 * 8/2015 Abbuhl ..... A47K 13/26
2006/0021120 A1 2/2006 Nickle
2006/0113504 A1 6/2006 Tollin
2006/0156458 A1 7/2006 Myers
2007/0250996 A1 11/2007 Li
2008/0172780 A1 7/2008 Shiau
2008/0209620 A1 9/2008 Hand et al.
2008/0213063 A1 9/2008 Pratt
2008/0219799 A1 9/2008 Auriol et al.
2008/0226411 A1 9/2008 McKinlay
2009/0092462 A1 4/2009 Pratt
2009/0113610 A1 5/2009 Un et al.
2009/0191020 A1 7/2009 Pratt
2009/0211005 A1 8/2009 Hand et al.
2009/0226278 A1 9/2009 Pratt
2010/0074710 A1 3/2010 Auriol et al.
2010/0150681 A1 6/2010 David et al.
2010/0260572 A1 10/2010 Wehrmeister et al.
2010/0275353 A1 11/2010 Gong
2011/0000010 A1 1/2011 Henne
2011/0058916 A1 3/2011 Toosky
2012/0042502 A1 2/2012 Wenfeng et al.
2013/0254981 A1 10/2013 Nelson et al.
2013/0269092 A1 * 10/2013 Hand ..... A47K 13/26 4/240
2015/0216379 A1 8/2015 Chen
2017/0020349 A1 * 1/2017 Yang ..... A47K 13/26

* cited by examiner

SYSTEM AND METHOD FOR REMOVABLY MOUNTING TOILET SEAT TO TOILET BOWL

TECHNICAL FIELD

This disclosure is generally directed to toilets and more particularly to a system and method for mounting a toilet seat to a toilet bowl while providing an easy method of removing the seat for cleaning or other purposes.

BACKGROUND

Toilet seats and lids have existed in various forms for many decades. A toilet seat provides a surface for an occupant to comfortably sit and a toilet lid provides a protective cover for the toilet facility. A toilet seat generally requires more frequent replacement than a toilet bowl due to wear and tear. Also, a toilet seat can be replaced to match a bathroom color scheme or motif. In most cases, a toilet seat can be replaced without replacing the entire toilet. Typically, a toilet seat is affixed to a toilet bowl by placing mounting screws or bolts through a flange portion of the toilet bowl and by fastening washers and screw nuts from the bottom surface of the toilet bowl to the mounting screws. In many cases, to replace the toilet seat, each of the screws or mounting bolts needs to be unfastened from the washers and nuts.

SUMMARY

According to one embodiment of this disclosure, a hinge assembly for a toilet seat includes a mounting base, a hinge leaf assembly, a threaded bolt, a threaded nut, a washer, and an expanding dowel. The hinge leaf assembly includes hinge leaves configured to attach to a toilet seat and a toilet lid. The threaded bolt is configured to attach the mounting base to a flange portion of a toilet bowl, the bolt having a bolt head at one end. The threaded nut has a sloped surface and is configured to screw onto the bolt. The washer has a sloped surface and is configured to surround the bolt between the bolt head and the nut. The expanding dowel is configured to expand outward and is further configured to surround the bolt between the washer and the nut.

In another embodiment, a toilet seat assembly includes a toilet seat, a toilet lid, and one or more hinge assemblies pivotally coupling the toilet seat and toilet lid. Each hinge assembly includes a mounting base, a hinge leaf assembly, a threaded bolt, a threaded nut, a washer, and an expanding dowel. The hinge leaf assembly includes hinge leaves configured to attach to a toilet seat and a toilet lid. The threaded bolt is configured to attach the mounting base to a flange portion of a toilet bowl, the bolt having a bolt head at one end. The threaded nut has a sloped surface and is configured to screw onto the bolt. The washer has a sloped surface and is configured to surround the bolt between the bolt head and the nut. The expanding dowel is configured to expand outward and is further configured to surround the bolt between the washer and the nut Other technical features may be readily apparent to one skilled in the art from the following figures, descriptions and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
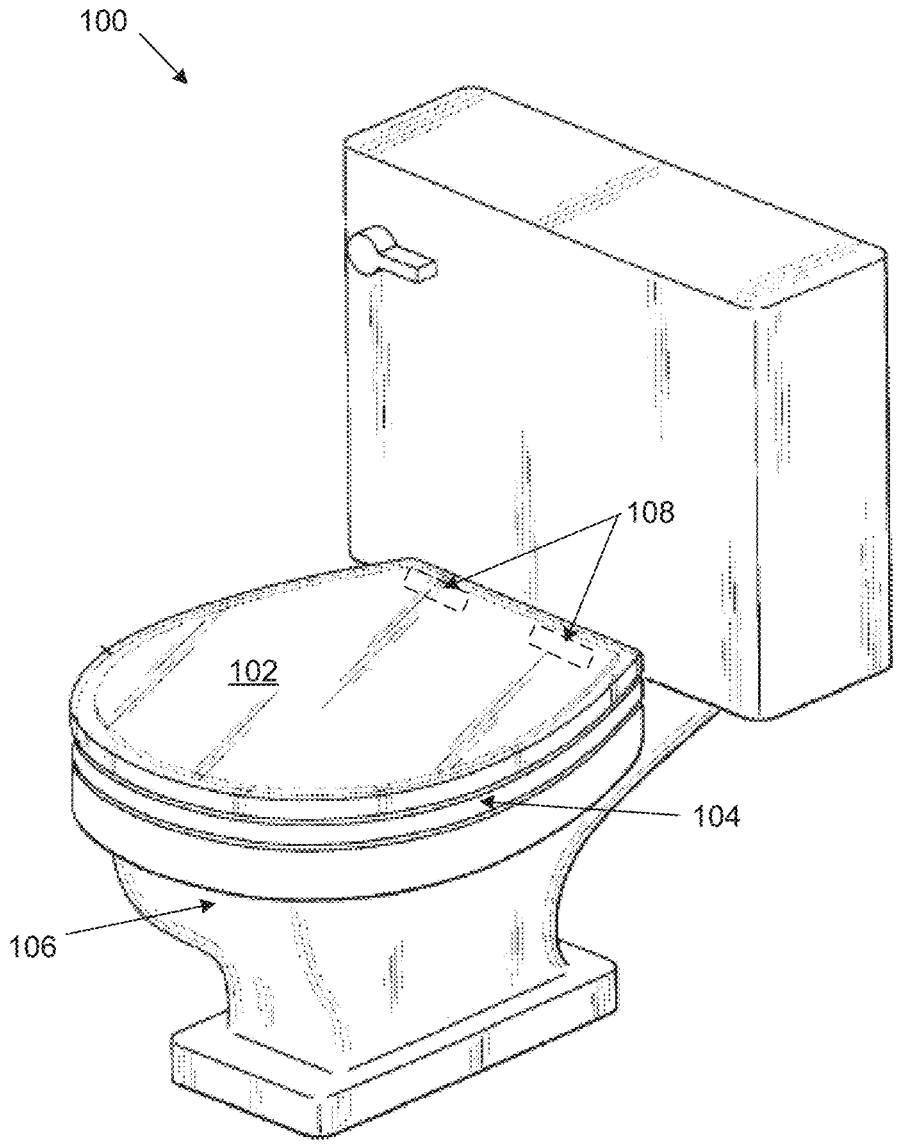
FIG. 1 illustrates a toilet with a toilet lid and seat configured for easy installation and removal, according to this disclosure.

FIGS. 1 through 14, described below, and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

Many conventional toilet seats are provided with two or more mounting bolts that pass through holes in the flange portion of the toilet bowel. To secure the toilet seat onto the toilet bowl, the mounting bolts are coupled to the toilet seat and inserted through the holes of the toilet bowl. Nuts and washers are then threaded onto the mounting bolts from the bottom side of the toilet bowl. To remove the toilet seat, it is necessary to loosen and unfasten the nuts from the mounting bolts. However, as mounting screws and bolts rust or corrode (especially in a moist environment), the screws or the mounting bolts can become difficult to loosen or unfasten. Furthermore, the nuts can recess due to the passage of time, making the nuts practically inaccessible and replacement of the toilet seat very difficult.

To address these and other issues, embodiments of this disclosure provide one or more hinge assemblies that are inexpensive to manufacture, yet provide for easy installation and quick release of a toilet seat from a toilet bowl and for replacing a toilet seat without undoing mounting screws or bolts from the toilet bowl. The disclosed hinge assemblies allow a user to lift off the toilet seat from the bowl without the need to turn, slide, or manipulate the hinge in any way. The disclosed embodiments provide a mounting system that can be used when there is only access to the top surface of the toilet bowl. Many modern toilet bowls are designed such that accessing the bottom of the bowl to hold or turn the mounting hardware is difficult. In addition, the hinges may often be soiled. Removing the seat for cleaning without having to touch the soiled hinge provides a new level of cleanliness for the user.

The disclosed hinge assemblies allow easy replacement of a toilet seat despite any rusted, corroded or deformed mounting bolts or nuts. In the disclosed embodiments, a toilet seat can be replaced without necessarily replacing mounting bolts or nuts. In addition, the disclosed hinge assemblies provide a solid, non-loosening mounting of the hardware to the bowl, which also self-centers to the mounting holes of the toilet bowl, and which prevents movement of mounting bolts.

The disclosed hinge assemblies also allow for adjustable tension on the holding strength of the hinge to the toilet bowl. While the tension is set to a reasonable standard, it is possible that the final user may wish to have stronger or less strong holding strength. For example, an older or physically impaired individual may wish to have a seat that is easier to remove for cleaning. The adjustability of the disclosed holding mechanism allows for such.

It will be understood that embodiments of this disclosure may include any one, more than one, or all of the features described here. In addition, embodiments of this disclosure may additionally or alternatively include other features not listed here. Although the disclosed embodiments are described with respect to a toilet seat, such description is not limiting since the disclosed embodiments are suitable for a wide range of applications.

FIG. 1 illustrates a toilet 100 with a toilet lid and seat configured for easy installation and removal, according to this disclosure. The embodiment of the toilet 100 shown in FIG. 1 is for illustration only. Other embodiments of the toilet 100 could be used without departing from the scope of this disclosure. Those skilled in the art will recognize that, for simplicity and clarity, some features and components are not explicitly shown in every figure, including those illustrated in connection with other figures. Such features, including those illustrated in other figures, will be understood to be equally applicable to the toilet 100. It will be understood that all features illustrated in the figures may be employed in any of the embodiments described. Omission of a feature or component from a particular figure is for purposes of simplicity and clarity, and not meant to imply that the feature or component cannot be employed in the embodiments described in connection with that figure.

As shown in FIG. 1, the toilet 100 is fitted with a toilet lid 102 and toilet seat 104 over a bowl 106. The toilet 100 may be any suitable toilet with a bowl that is configured to be covered by a seat and lid. The bowl 106 has an opening that is generally round or oval in shape. The toilet lid 102 and toilet seat 104 have a size and shape configured to generally match the size and shape of the bowl 106 and to cover the opening of the bowl 106. The toilet lid 102 and toilet seat 104 are pivotally coupled to each other and secured to a rear portion of the bowl 106 or toilet 100 using a pair of hinge assemblies 108 that allow the toilet lid 102 and toilet seat 104 to raise and lower independently with respect to the bowl 106 and to each other. The hinge assemblies 108 are secured to a flange portion at the rear of the bowl 106. The hinge assemblies 108 are configured for easy installation and removal of the toilet lid 102, toilet seat 104, or both. Further details regarding the hinge assemblies 108 are provided below.

Although FIG. 1 depicts one example of a toilet 100 with a toilet lid 102 and toilet seat 104, various changes may be made to FIG. 1. For example, while the bowl 106 is depicted as generally round or oval in shape, the bowl 106 could include other shapes, such as a rectangle or octagon. Likewise, while FIG. 1 illustrates a general placement and arrangement for the hinge assemblies 108 with respect to the toilet 100, this is for illustration purposes only. The exact placement, shape, and quantity of the hinge assemblies 108 could vary depending on the embodiment.

Figure 2:
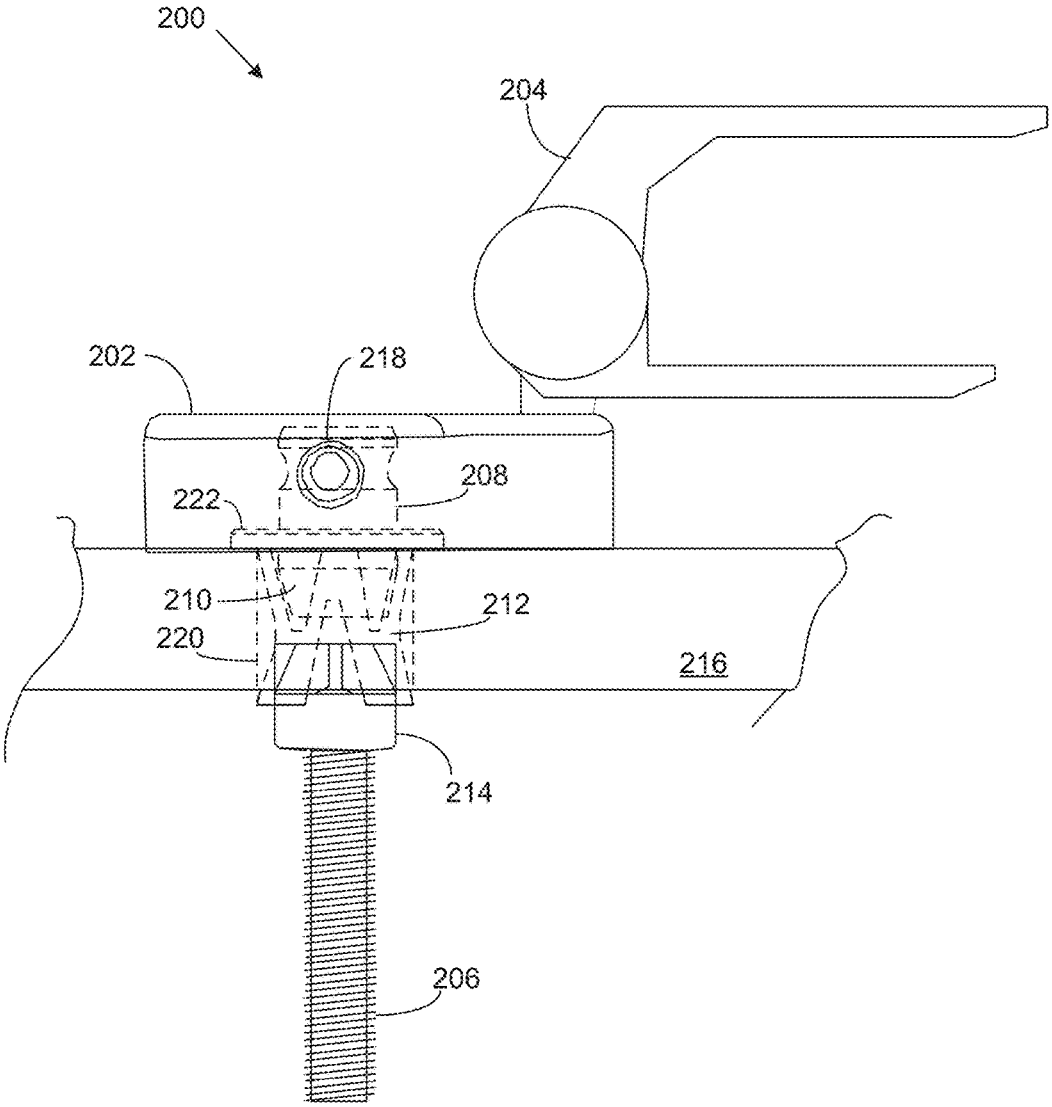
FIG. 2 illustrates details of an example hinge assembly according to this disclosure.

FIG. 2 illustrates details of an example hinge assembly 200 according to this disclosure. The embodiment of the hinge assembly 200 shown in FIG. 2 is for illustration only. Other embodiments of the hinge assembly 200 could be used without departing from the scope of this disclosure. For ease of explanation, the hinge assembly 200 may represent either or both of the hinge assemblies 108 of FIG. 1. It will be understood, however, that the hinge assembly 200 may represent any other suitable hinge assembly.

As shown in FIG. 2, the hinge assembly 200 includes a mounting base 202, a hinge leaf assembly 204, a threaded bolt 206 with a uniquely shaped bolt head 208, a washer 210, an expanding dowel 212, and a nut 214.

The mounting base 202 is disposed on a top surface of a flange portion 216 of a toilet bowl, such as the bowl 106 of FIG. 1. In most toilets, the flange portion 216 is located at the rear portion of the toilet bowl, typically near the water tank. The mounting base 202 has an opening on a bottom surface that allows the mounting base 202 to be placed over the bolt head 208, with the bolt head 208 fitting snugly in the opening. The mounting base 202 also has a threaded opening 218 on a side surface. The threaded opening 218 is configured to accept an adjustable tensioning device (depicted in FIG. 5) that screws into the threaded opening 218 and applies pressure to the bolt head 208, thereby securing the mounting base 202 to the bolt head 208.

The hinge leaf assembly 204 is fixedly or removably attached to the top surface of the mounting base 202. The hinge leaf assembly 204 is configured for attachment of a toilet lid, a toilet seat, or both, and provides for hinged movement of the toilet lid and/or toilet seat from a raised position to a lowered position, and vice versa. The mounting base 202 and hinge leaf assembly 204 are formed of a durable, non-corrosive material, such as stainless steel or a hard plastic.

Figure 3:
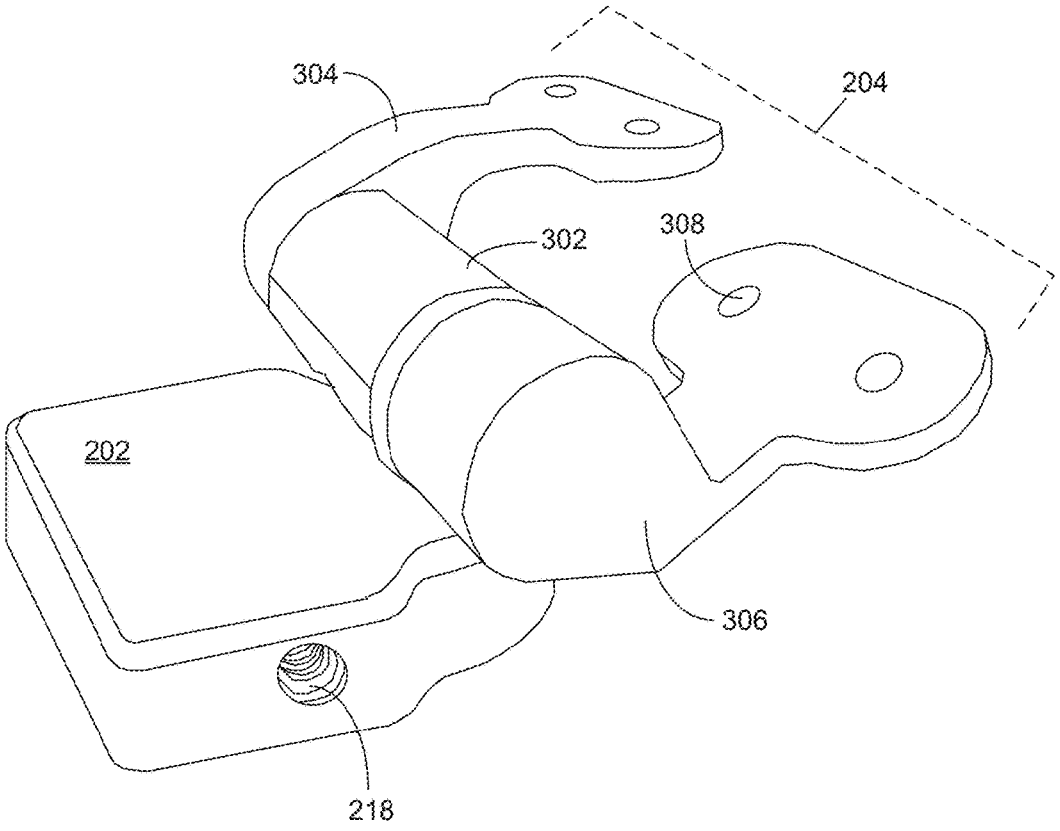
FIG. 3 illustrates additional details of a mounting base and hinge leaf assembly according to this disclosure.

FIG. 3 illustrates additional details of the mounting base 202 and hinge leaf assembly 204 according to this disclosure. As shown in the perspective view of FIG. 3, the hinge leaf assembly 204 is disposed on the top surface of the mounting base 202. The hinge leaf assembly 204 includes a fixed center portion 302 and two hinge leaves 304-306 that pivot about the center portion 302. The hinge leaf 304 is configured for attachment to a toilet seat (e.g., the toilet seat 104 of FIG. 1), and the hinge leaf 306 is configured for attachment to a toilet lid (e.g., the toilet lid 102 of FIG. 1). Each of the hinge leaves 304-306 includes mounting holes 308 for mounting hardware (e.g, screws, bolts, other fasteners, and the like) that secures the hinge leaf 304-306 to the corresponding toilet lid or seat. In some embodiments, the center portion 302 can include springs or dampers to control the pivotal movement of the hinge leaves 304-306, thereby providing a slow-close toilet lid and seat.

Figure 4A:
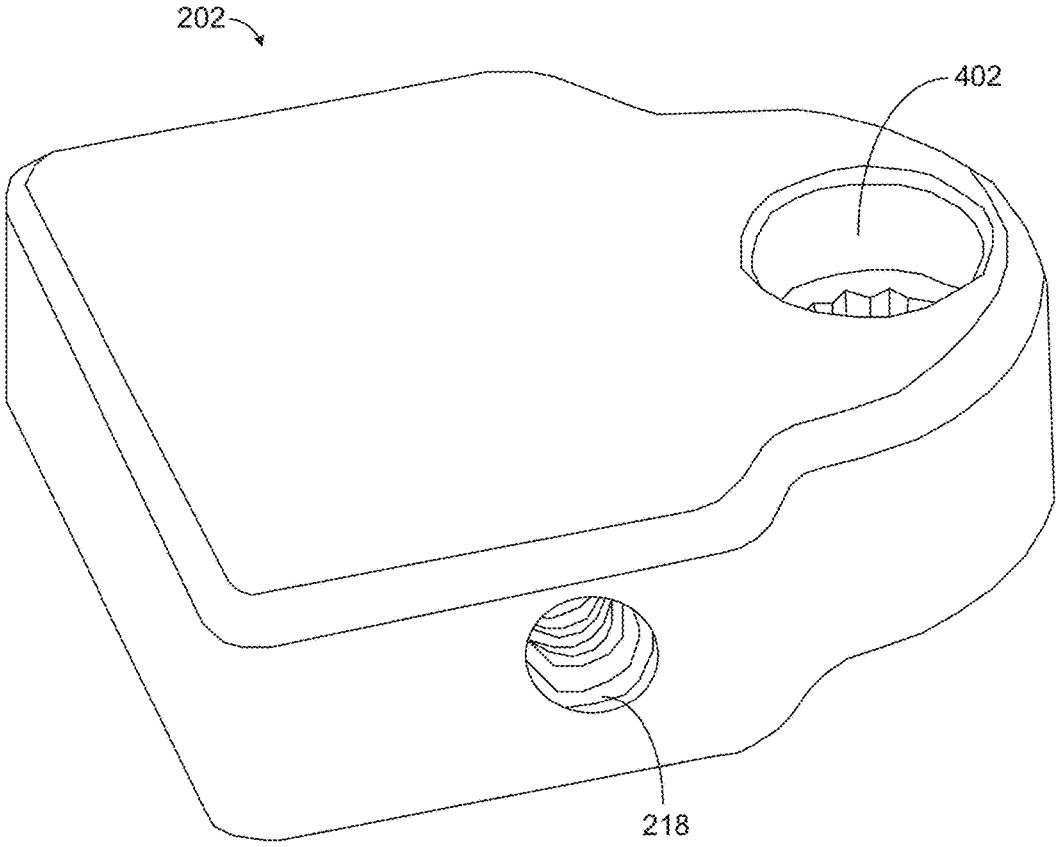
FIGS. 4A through 4C illustrate additional details of the mounting base with the hinge leaf assembly removed, according to this disclosure.
Figure 4B:
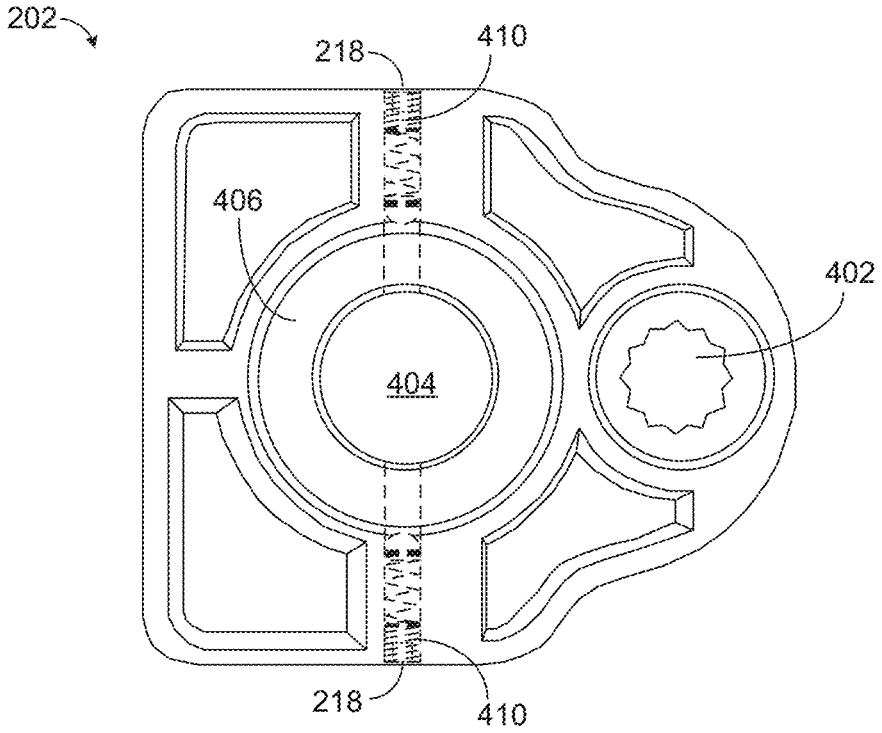
Figure 4C:
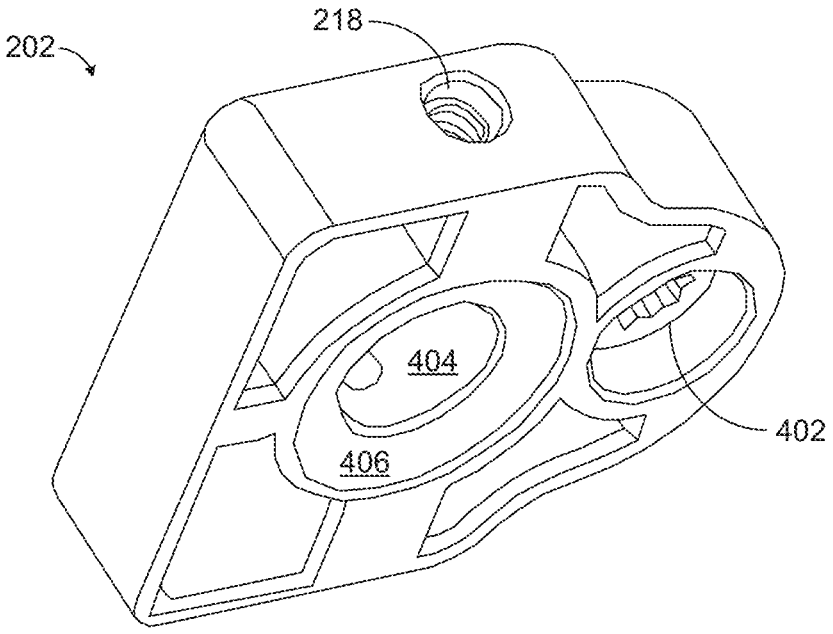

FIGS. 4A through 4C illustrate additional details of the mounting base 202 with the hinge leaf assembly 204 removed, according to this disclosure. FIG. 4A illustrates a perspective view of the top surface of the mounting base 202, FIG. 4B illustrates a plan view of the bottom surface of the mounting base 202, and FIG. 4C illustrates a perspective view of the bottom surface of the mounting base 202.

As shown in FIGS. 4A through 4C, the mounting base 202 includes a mounting hole 402 configured to accept the hinge leaf assembly 204. In some embodiments, the mounting hole 402 has a star-shaped inner surface that corresponds to a similar shaped stem on the bottom of the hinge leaf assembly 204. The star-shaped surface of the mounting hole 402 promotes correct alignment of the hinge leaf assembly 204 with the mounting base 202.

As shown in FIGS. 4B and 4C, the bottom surface of the mounting base 202 includes a deep recess 404 and a shallow recess 406. The recesses 404-406 are both generally circular and are co-axial. When the mounting base 202 is installed as shown in FIG. 2, the deep recess 404 is configured to accept the bolt head 208, while the shallow recess 406 is configured to accept a flange 222 around the bottom of the bolt head 208.

Two threaded openings 218 are disposed on opposite sides of the mounting base 202. Each threaded opening 218 passes through the mounting base 202 from an outer surface to the deep recess 404. Each threaded opening 218 is configured to accept an adjustable tensioning device 410 that screws into the threaded opening 218 and applies pressure to the bolt head 208 when the mounting base 202 and bolt head 208 are installed as shown in FIG. 2. FIGS. 4A and 4C show the threaded openings 218 without an adjustable tensioning device 410, while FIG. 4B shows adjustable tensioning devices 410 screwed into the threaded openings 218. When the mounting base 202 and bolt head 208 are installed as shown in FIG. 2, and the adjustable tensioning devices 410 are completely advanced, the mounting base 202 is secured to the bolt head 208 by the adjustable tensioning devices 410.

Figure 5:
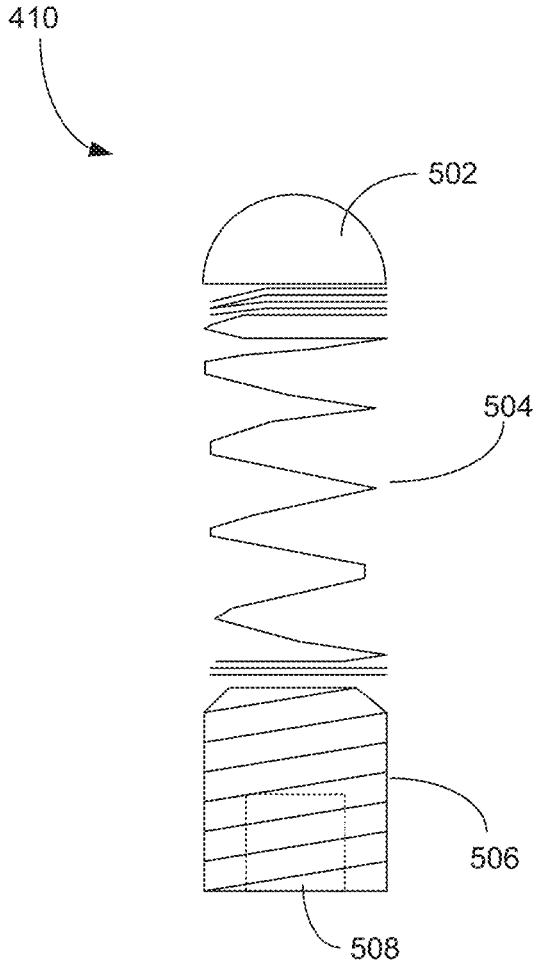
FIG. 5 illustrates additional details of an adjustable tensioning device, according to this disclosure.

FIG. 5 illustrates additional details of the adjustable tensioning device 410, according to this disclosure. As shown in FIG. 5, the adjustable tensioning device 410 includes tip 502, a spring 504, and a set screw 506. The tip 502 is a rounded tip that is configured to engage with a surface of the bolt head 208. The tip 502 is formed of a durable material, such as a metal or hard plastic. The spring 504 is a compression spring that applies pressure to the tip 502 and to the bolt head 208 when the adjustable tensioning device 410 is advanced far enough in the threaded opening 218 that the tip 502 makes contact with the bolt head 208. Once the tip 502 makes contact with the bolt head 208, further advancement of the adjustable tensioning device 410 causes the spring 504 to compress and apply additional pressure to the tip 502 and to the bolt head 208.

The set screw 506 is a threaded set screw that is coupled to the spring 504 and is configured to change the amount of compression on the spring 504, thereby changing the pressure on the bolt head 208. The threads of the set screw 506 correspond to the threaded inner surface of the threaded openings 218 of the mounting base 202. As shown in FIG. 5, the set screw 506 has a hex head 508 configured to accept a hex wrench or Allen wrench. Of course, this is merely one example. Other embodiments of the set screw 506 could have a slotted head, a Phillips head, or be configured for advancement by any other suitable wrench or screwdriver.

Turning again to FIG. 2, it can be seen that the bolt head 208 of the bolt 206 rests on the top surface of the flange portion 216 of the toilet bowl, while the threaded portion of the bolt 206 extends through an opening 220 in the flange portion 216. The flange 222 around the bottom of the bolt head 208 keeps the bolt head 208 from falling through the opening 220. The bolt 206 and bolt head 208 are formed of a durable, non-corrosive material, such as stainless steel or a hard plastic. In some embodiments, the bolt 206 and bolt head 208 are separate parts, and the bolt head 208 may include a threaded opening on its bottom surface to allow the threaded portion of the bolt 208 to screw into the bolt head 208. In other embodiments, the bolt 206 and bolt head 208 are formed together as one integral unit that cannot be readily separated by a user or customer.

Figure 6A:
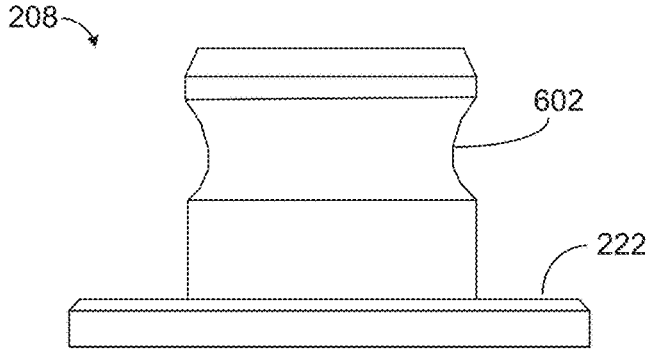
FIGS. 6A through 6C illustrate additional details of a bolt head, according to this disclosure.
Figure 6B:
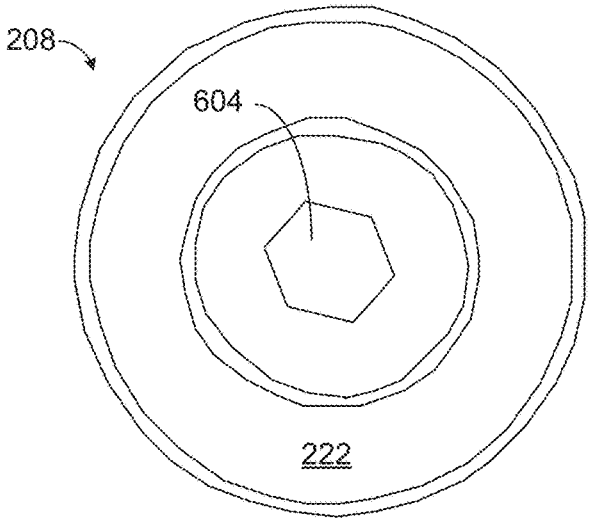
Figure 6C:
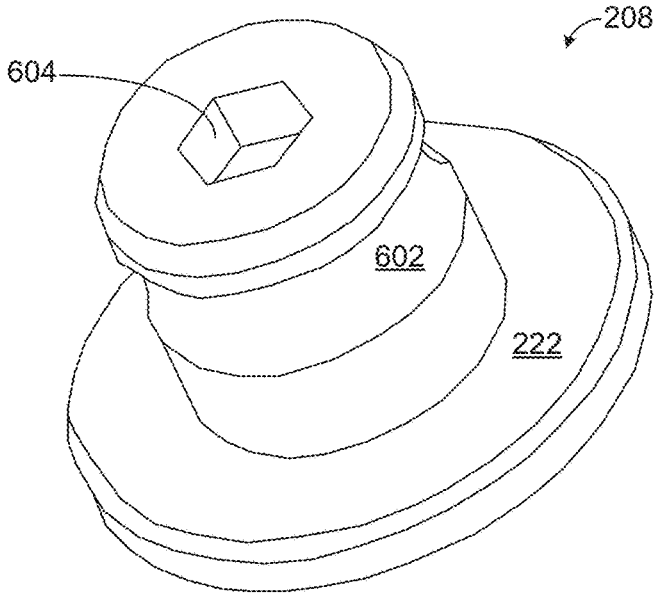

FIGS. 6A through 6C illustrate additional details of the bolt head 208, according to this disclosure. FIG. 6A illustrates a side plan view, FIG. 6B, illustrates a top plan view, and FIG. 6C illustrates a perspective view. As shown in FIGS. 6A through 6C, the bolt head 208 includes a curved surface 602 and a hex slot 604. The curved surface 602 is a concave surface that extends around the bolt head 208. The curved surface 602 provides a depression on the side of the bolt head 208 in which the tip 502 of the adjustable tensioning device 410 can engage once the mounting base 202 is installed over the bolt head 208 (as shown in FIG. 2) and the adjustable tensioning device 410 is advanced into the threaded opening 218 (as shown in FIG. 4B). The hex slot 604 is configured to accept a hex wrench or Allen wrench. The wrench can be used to rotate the bolt head 208, or stabilize the bolt head 208 as the nut 214 is turned with respect to the bolt 206. Of course, the hex slot 604 is merely one example. Other embodiments of the bolt head 208 could have a slotted head, a Phillips head, or be configured for advancement by any other suitable wrench or screwdriver.

Turning again to FIG. 2, it can be seen that the bolt 206 also passes through the washer 210, expanding dowel 212, and nut 214. The washer 210, expanding dowel 212, and nut 214 are configured to be arranged together to form a tight coupling between the mounting base 202, the bolt 206, and the flange portion 216.

Figure 7:
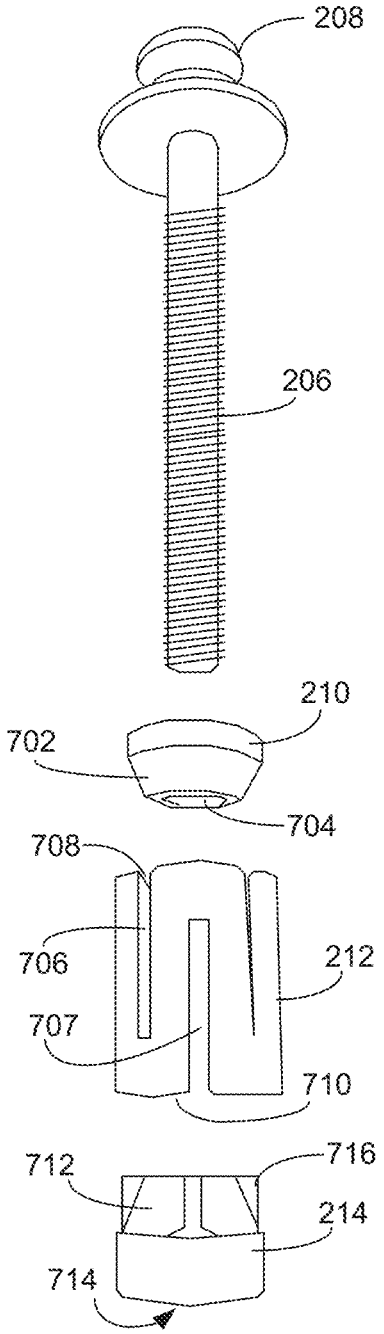
FIGS. 7 and 8 illustrate additional details of components of a hinge assembly according to this disclosure.
Figure 8:
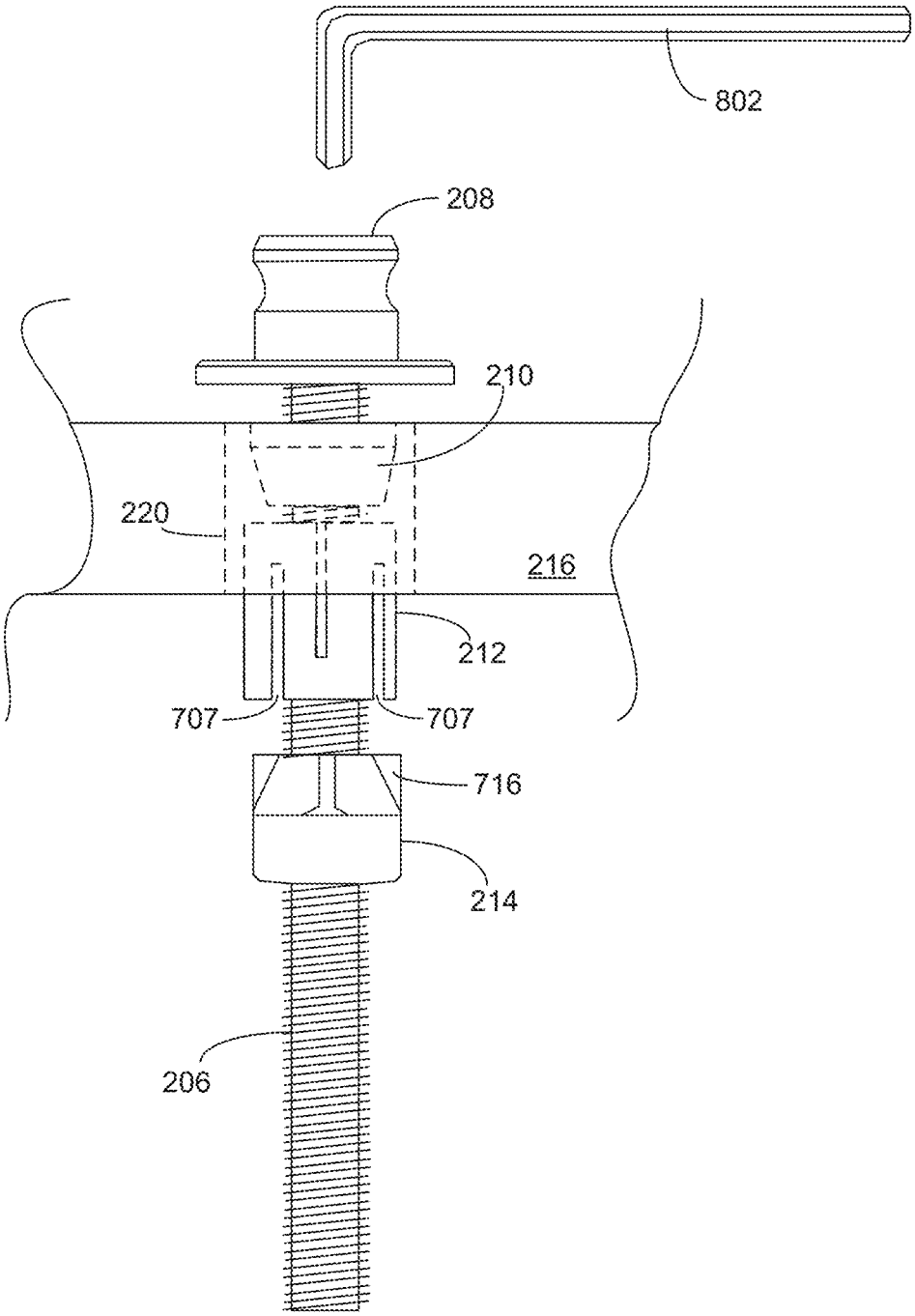

FIGS. 7 and 8 illustrate additional details of the bolt 206, bolt head 208, washer 210, expanding dowel 212, and nut 214 according to this disclosure. FIG. 7 illustrates the components 206-214 in an unassembled view, while FIG. 8 illustrates the components 206-214 in a partially assembled view. The washer 210 is shaped generally like a partial cone with a sloped surface 702 and an opening 704 through the center.

The expanding dowel 212 is generally cylindrical in shape, with an opening through the center. Each end of the expanding dowel has a sloped inner surface 708-710 that extends inward from an end of the expanding dowel 212 to the opening through the center. The sloped surface 708 aligns with the sloped surface 702 of the washer 210, while the sloped surface 710 aligns with a sloped surface 712 on the nut 214. The expanding dowel 212 also includes longitudinally oriented expansion slots 706-707 disposed around the perimeter of the expanding dowel 212. Each expansion slot 706-707 extends partially along the length of the expanding dowel 212, and the starting point of the expansion slots 706-707 alternates between ends of the expanding dowel 212 in an interleaved pattern. That is, a first expansion slot 706 extends from a first end of the expanding dowel 212, while expansion slots 707 on either side of the first expansion slot 706 extend from a second end of the expanding dowel 212. In an embodiment, there are a total of eight expansion slots 706-707—four expansion slots 706 arranged at ninety degree intervals, and four expansion slots 707 arranged at ninety degree intervals, where the expansion slots 706 are offset from the adjacent expansion slots 707 by forty-five degrees. Of course, this is merely one example, and other numbers, spacings, and configurations of expansion slots 706-707 are within the scope of this disclosure.

Like the washer 210, the nut 214 has a shape that is generally similar to a partial cone, with the sloped surface 712 and an opening 714 through the center. Extending radially from the sloped surface 712 are multiple fins 716. The fins 716 are disposed at ninety degree intervals around the perimeter of the sloped surface 712 and align with the expansion slots 707 of the expanding dowel 212. The nut 214 also includes threads on an internal surface of the opening 714. The threads are configured to mate with the threaded portion of the bolt 208.

As shown in FIG. 8, the washer 210 and expanding dowel 212 are axially aligned, with the bolt 206 passing through the openings in the washer 210 and expanding dowel 212. The bolt 206, washer 210, and expanding dowel 212 are placed through the opening 220 in the flange portion 216. Then the nut 214 is threaded on the end of the bolt 206 and advanced toward the expanding dowel 212. The nut 214 can be advanced by holding the bolt head 208 steady and turning the nut 214, or by holding the nut 214 steady and turning the bolt head 208. A wrench 802 fits into the hex slot 604 and can be used to turn the bolt head 208 or hold the bolt head 208 steady. As the nut 214 is advanced up the bolt 206 toward the expanding dowel 212, the fins 716 on the nut 214 align with and engage the corresponding expansion slots 707 of the expanding dowel 212. In addition, the sloped surface 702 on the washer 210 and sloped surface 712 on the nut 214 move closer together and eventually contact the sloped surfaces 708-710 of the expanding dowel 212. With further advancement of the nut 214 on the bolt 206, the sloped surfaces 702, 712 squeeze (i.e., apply opposing compressive forces to) the sloped surfaces 708-710 of the expanding dowel 212, thereby causing the expansion slots 706-707 to widen and cause the expanding dowel 212 to expand outward (i.e., increase in diameter) to touch the inner surface of the opening 220 in the flange portion 216. Further tightening of the nut 214 on the bolt 206 causes further outward expansion pressure on the expanding dowel 212, thereby creating a tight fit between the expanding dowel 212 and the opening 220, as shown in FIG. 2.

Once the nut 214 is tight, the bolt 206 is securely attached in the center of the opening 220, and the bolt head 208 is securely attached to the top surface of the flange portion 216. The mounting base 202 (which is attached to the toilet lid and seat) can then be placed over the bolt head 208, and an adjustable tensioning device 410 can be advanced in each threaded opening 218 until it contacts and tightens against the curved surface 602 of the bolt head 208. This securely locks the toilet lid and seat to the toilet. A simple loosening of each adjustable tensioning device 410 allows the toilet lid and seat (and mounting base 202) to be lifted up and removed from the bolt head 208.

Although FIGS. 2 through 8 depict various details of one example of a hinge assembly 200, various changes may be made to FIGS. 2 through 8. For example, while shown comprised of certain components, the hinge assembly 200 may include more or fewer components. Components shown in FIGS. 2 through 8 may be removed, repeated, or arranged in a different order. Components may have dimensions other than those shown or described. Other components, composed of the same or different materials, may be added to the hinge assembly 200.

Figure 9:
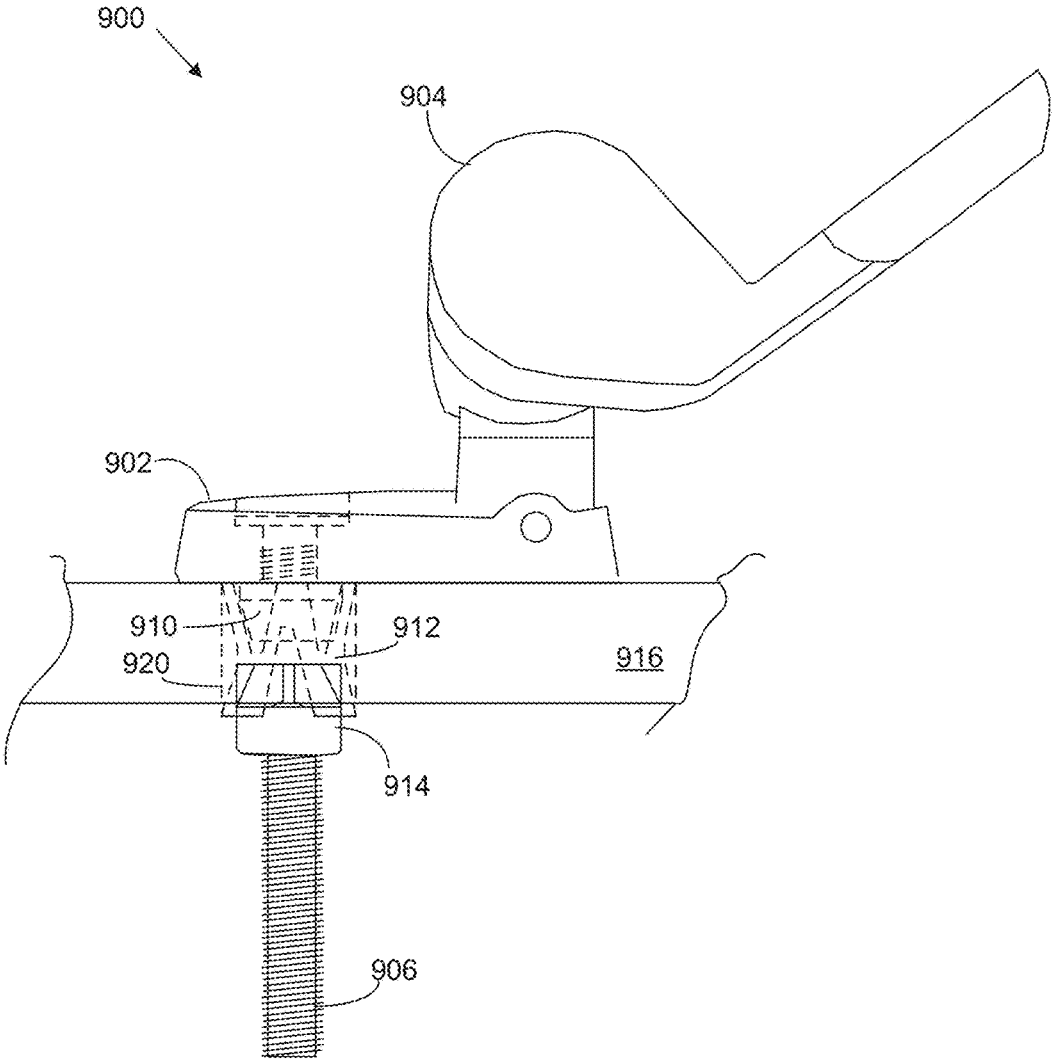
FIG. 9 illustrates details of another example hinge assembly according to this disclosure.

FIG. 9 illustrates details of another example hinge assembly 900 according to this disclosure. In this embodiment, a mounting base attaches to the toilet bowl in a manner such that the mounting base remains on the toilet bowl when the seat is lifted off. The embodiment of the hinge assembly 900 shown in FIG. 9 is for illustration only. Other embodiments of the hinge assembly 900 could be used without departing from the scope of this disclosure. For ease of explanation, the hinge assembly 900 may represent either or both of the hinge assemblies 108 of FIG. 1. It will be understood, however, that the hinge assembly 900 may represent any other suitable hinge assembly.

As shown in FIG. 9, the hinge assembly 900 includes a mounting base 902, a hinge leaf assembly 904, a threaded bolt 906, a washer 910, an expanding dowel 912, and a nut 914.

The mounting base 902 is disposed on a top surface of a flange portion 916 of a toilet bowl, such as the bowl 106 of FIG. 1. The hinge leaf assembly 904 is removably attached to the top surface of the mounting base 902. The hinge leaf assembly 904 is configured for attachment of a toilet lid, a toilet seat, or both, and provides for hinged movement of the toilet lid and/or toilet seat from a raised position to a lowered position, and vice versa. The mounting base 902 and hinge leaf assembly 904 are formed of a durable, non-corrosive material, such as stainless steel or a hard plastic.

Figure 10A:
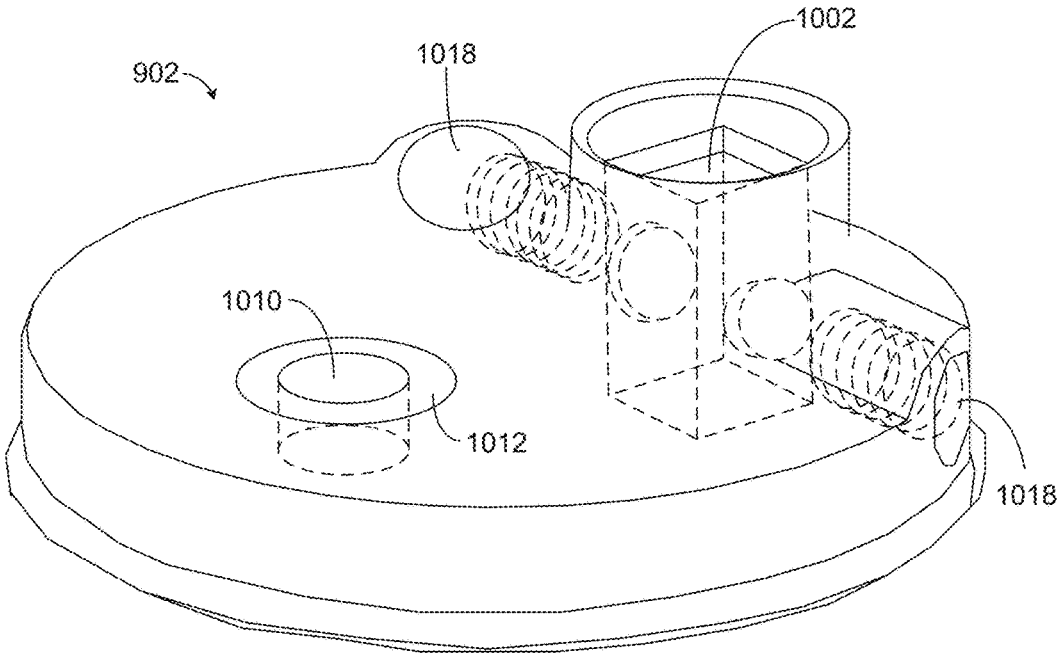
FIGS. 10A through 10C illustrate additional details of a mounting base with a hinge leaf assembly removed, according to this disclosure.
Figure 10B:
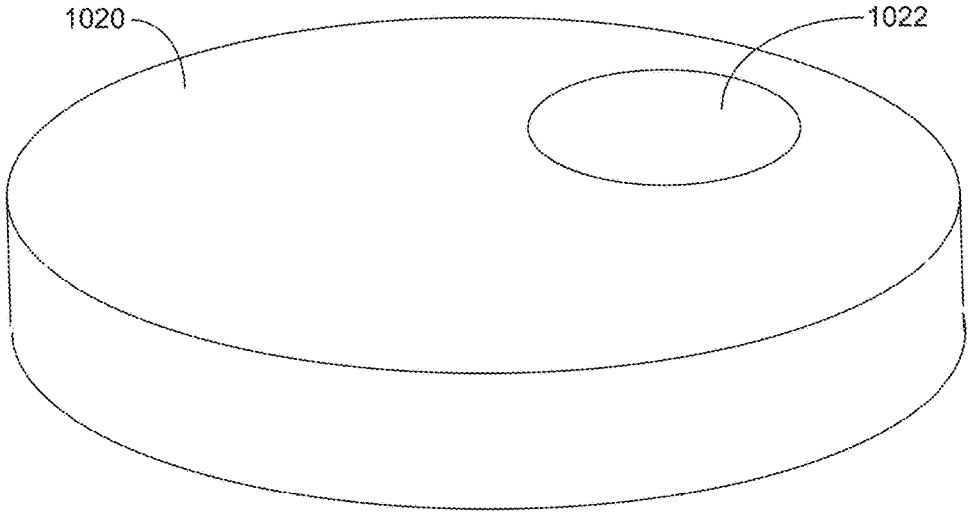
Figure 10C:
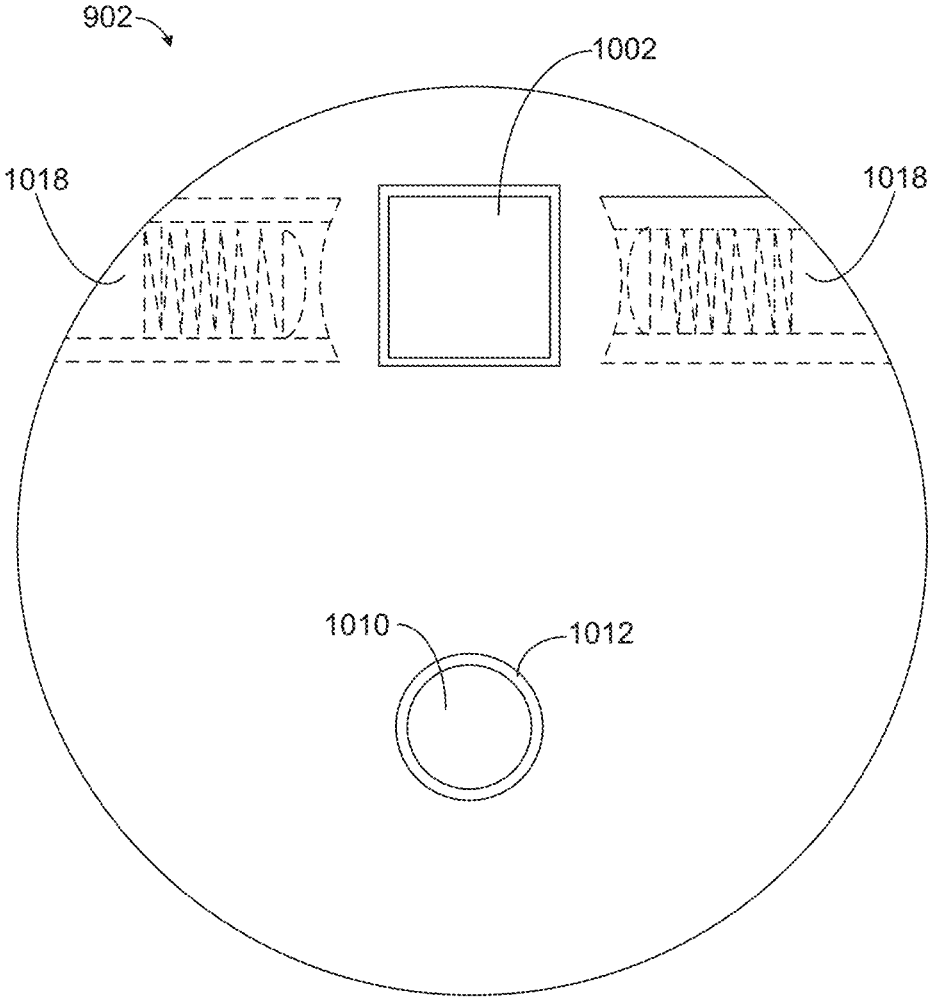

FIGS. 10A through 10C illustrate additional details of the mounting base 902 with the hinge leaf assembly 904 removed, according to this disclosure. FIG. 10A illustrates a perspective view of the mounting base 902, FIG. 10B illustrates a perspective view of a cap 1020 that can cover the mounting base 902, and FIG. 10C illustrates a plan view of the top surface of the mounting base 902.

As shown in FIGS. 10A and 10C, the mounting base 902 includes a mounting hole 1002 configured to accept a square stem 1110 (shown in FIG. 11) on the bottom of the hinge leaf assembly 904. The mounting hole 1002 has a square-shaped inner surface that corresponds to the square cross-section of the square stem 1110 of the hinge leaf assembly 904. The square-shaped surface of the mounting hole 1002 promotes correct alignment of the hinge leaf assembly 904 with the mounting base 902.

Two threaded openings 1018 are disposed on opposite sides of the mounting base 902. Each threaded opening 1018 passes through the mounting base 902 from an outer surface to the square-shaped inner surface of the mounting hole 1002. Each threaded opening 1018 is configured to accept an adjustable tensioning device 410 that screws into the threaded opening 1018 and contacts circular recesses 1112 (shown in FIG. 11) of the square stem 1110. When the mounting base 902 and hinge leaf assembly 904 are installed as shown in FIG. 9, and the adjustable tensioning devices 410 are completely advanced, the hinge leaf assembly 904 is secured to the mounting base 902 by the adjustable tensioning devices 410.

The mounting base 902 also includes a mounting hole 1010 configured to accept the bolt 906 for installing the mounting base 902 to the flange portion 916 of the toilet bowl. In some embodiments, the mounting hole 1010 includes a shallow recess 1012 with a diameter larger than the mounting hole 1010. The shallow recess 1012 can receive the head of the bolt 906 for a flush or nearly flush assembly. Once the mounting base 902 is installed on the flange portion 916, the mounting base 902 can be covered with the cap 1020. The cap 1020 includes an opening 1022 through which the top part of the mounting hole 1002 can pass.

Figure 11:
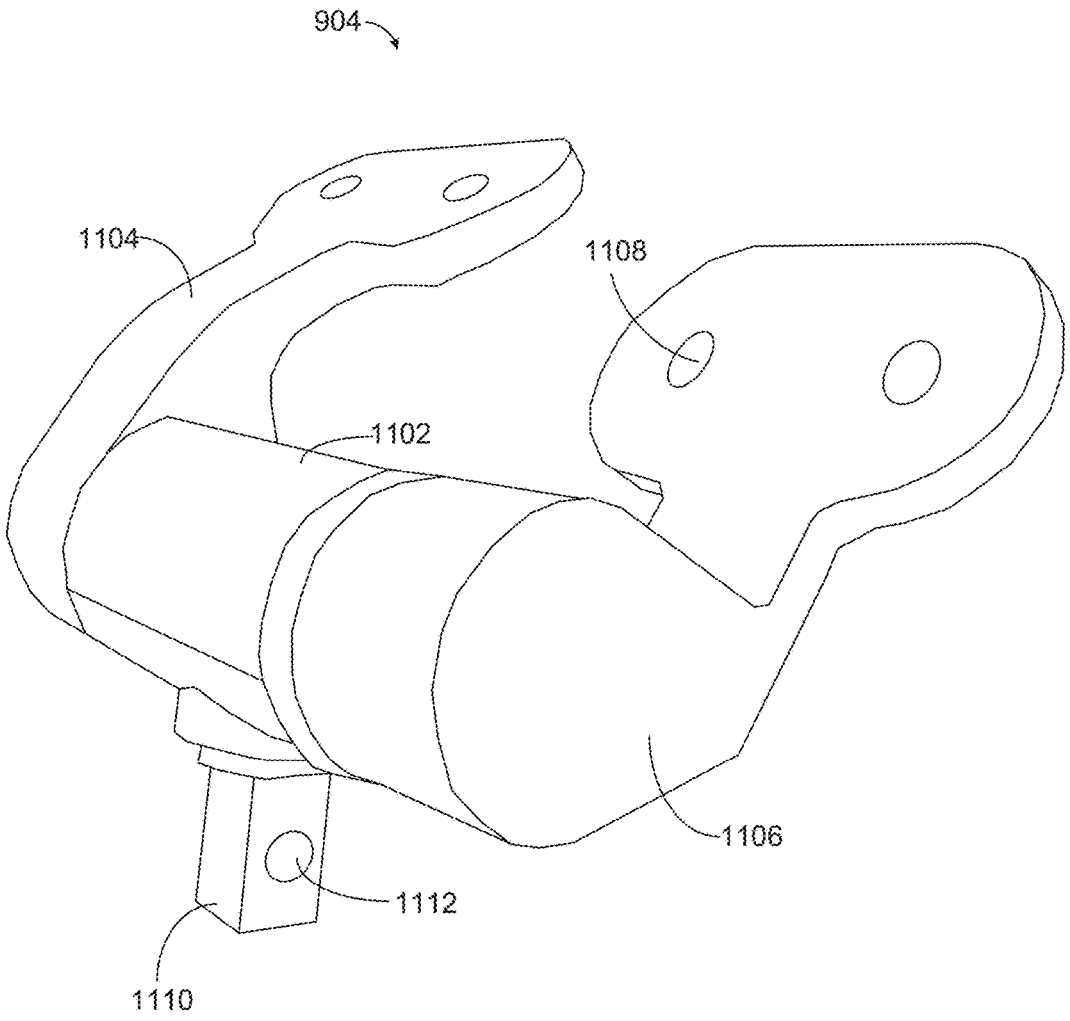
FIG. 11 illustrates additional details of a hinge leaf assembly according to this disclosure.

FIG. 11 illustrates additional details of the hinge leaf assembly 904 according to this disclosure. As shown in FIG. 11, the hinge leaf assembly 904 includes a fixed center portion 1102 and two hinge leaves 1104-1106 that pivot about the center portion 1102. The hinge leaf 1104 is configured for attachment to a toilet seat (e.g., the toilet seat 104 of FIG. 1), and the hinge leaf 1106 is configured for attachment to a toilet lid (e.g., the toilet lid 102 of FIG. 1). Each of the hinge leaves 1104-1106 includes mounting holes 1108 for mounting hardware (e.g., screws, bolts, other fasteners, and the like) that secures the hinge leaf 1104-1106 to the corresponding toilet lid or seat. In some embodiments, the center portion 1102 can include springs or dampers to control the pivotal movement of the hinge leaves 1104-1106, thereby providing a slow-close toilet lid and seat.

The hinge leaf assembly 904 also includes a square stem 1110 with circular recesses 1112 on opposite sides of the stem 1110. The stem 1110 is configured to insert into the mounting hole 1002 in the mounting base 902. When the stem 1110 is inserted into the mounting hole 1002, a tip of a tensioning device (e.g., the adjustable tensioning device 410) interfaces with circular recesses 1112 to hold the hinge leaf assembly 904 in place.

Turning again to FIG. 9, it can be seen that the bolt 906 extends downward through the mounting base 902. In particular, the bolt 906 extends through the mounting hole 1010 depicted in FIG. 10. Because the diameter of the mounting hole 1010 is smaller than the diameter of the head of the bolt 906, the bolt 906 cannot fall through the mounting hole 1010. In some embodiments, the head of the bolt 906 rests on the shallow recess 1012 depicted in FIG. 10. The bolt 906 also passes through the washer 910, expanding dowel 912, and nut 914. The washer 910, expanding dowel 912, and nut 914 are configured to be arranged together to form a tight coupling between the mounting base 902, the bolt 906, and the flange portion 916.

Figure 12:
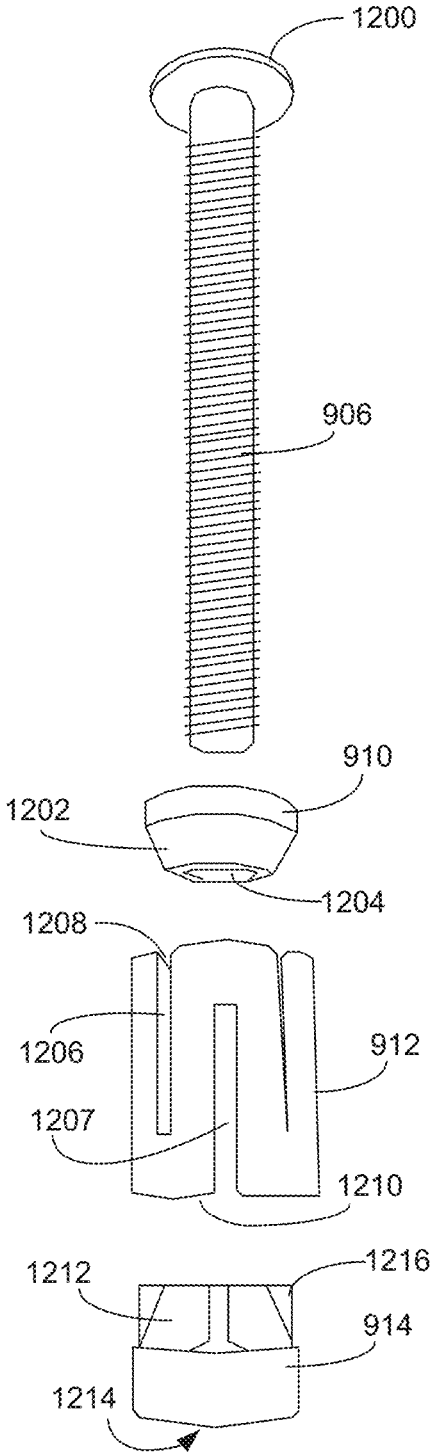
FIGS. 12 and 13 illustrate additional details of components of a hinge assembly according to this disclosure.
Figure 13:
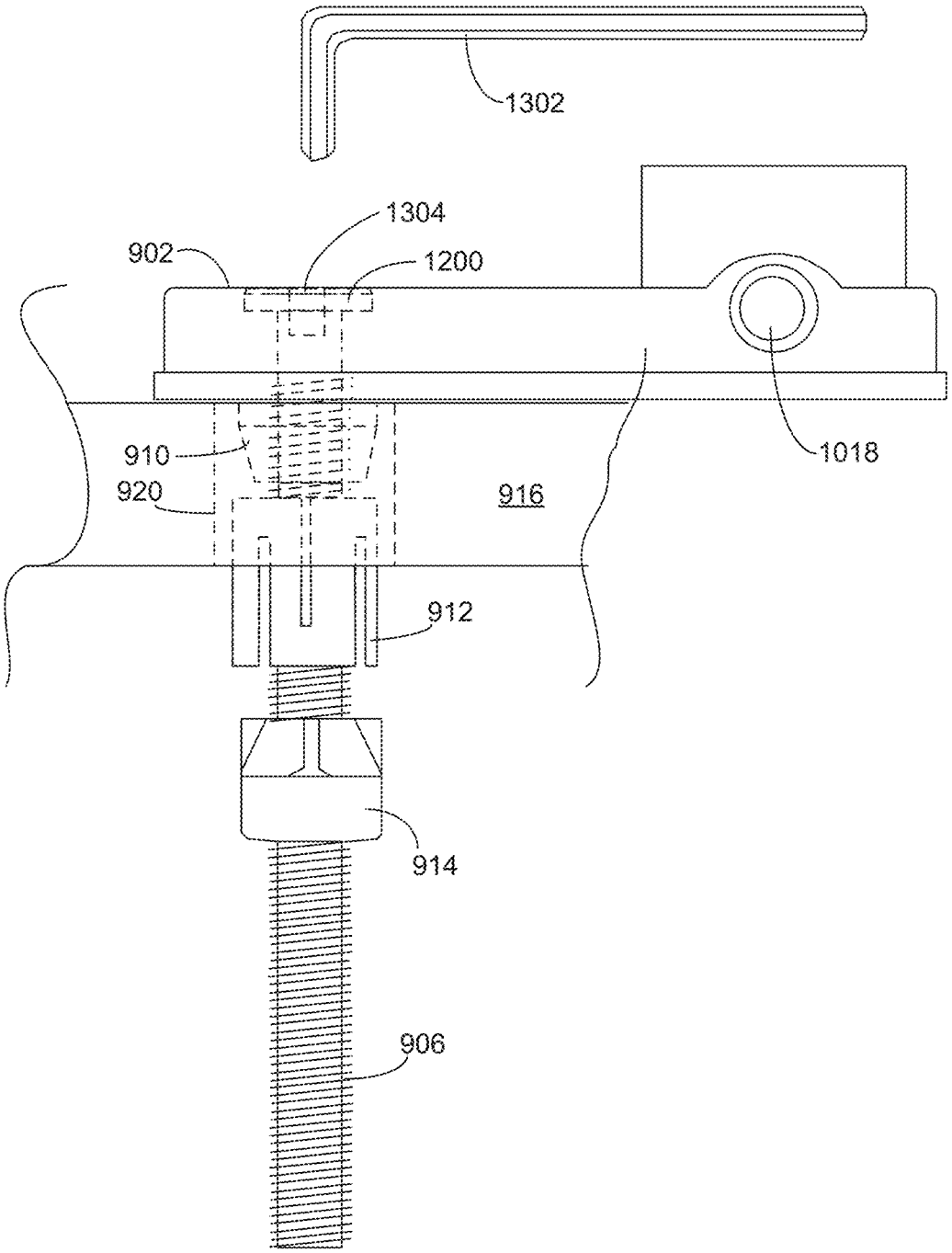

FIGS. 12 and 13 illustrate additional details of the bolt 906, washer 910, expanding dowel 912, and nut 914 according to this disclosure. FIG. 12 illustrates the components 906-914 in an unassembled view, while FIG. 13 illustrates the components 906-914 in a partially assembled view.

The bolt 906 is formed of a durable, non-corrosive material, such as stainless steel or a hard plastic and includes a bolt head 1200 configured to accept a hex wrench, screwdriver, or other fastener driver. The washer 910, expanding dowel 912, and nut 914 are the same as, or similar to, the washer 210, expanding dowel 212, and nut 214 of FIG. 2. Accordingly, certain details of the components 910-914 will not be described in detail. The washer 910 includes a sloped surface 1202 and an opening 1204 through the center. The expanding dowel 912 is generally cylindrical in shape, and each end of the expanding dowel 912 has a sloped inner surface 1208-1210 that extends inward. The sloped surface 1208 aligns with the sloped surface 1202 of the washer 910, while the sloped surface 1210 aligns with a sloped surface 1212 on the nut 914. The expanding dowel 912 also includes longitudinally oriented expansion slots 1206-1207 disposed around the perimeter of the expanding dowel 212 and arranged like those of the expanding dowel 212. The nut 914 has the sloped surface 1212 and an opening 1214 through the center. Extending radially from the sloped surface 1212 are multiple fins 1216. The nut 914 also includes threads on an internal surface of the opening 1214. The threads are configured to mate with the threaded portion of the bolt 906.

As shown in FIG. 13, the washer 910 and expanding dowel 912 are axially aligned, with the bolt 906 passing through the openings in the washer 910 and expanding dowel 912. The bolt 906, washer 910, and expanding dowel 912 are placed through the opening 920 in the flange portion 916. Then the nut 914 is threaded on the end of the bolt 906 and advanced toward the expanding dowel 912. The nut 914 can be advanced by holding the bolt head 1200 steady and turning the nut 914, or by holding the nut 914 steady and turning the bolt head 1200. A wrench 1302 fits into a slot 1304 on the bolt head 1200 and can be used to turn the bolt head 1200 or hold the bolt head 1200 steady.

As the nut 914 is advanced up the bolt 906 toward the expanding dowel 912, the fins 1216 on the nut 914 align with and engage the corresponding expansion slots 1207 of the expanding dowel 912. In addition, the sloped surface 1202 on the washer 910 and sloped surface 1212 on the nut 914 move closer together and eventually contact the sloped surfaces 1208-1210 of the expanding dowel 912. With further advancement of the nut 914 on the bolt 906, the sloped surfaces 1202, 1212 squeeze (i.e., apply opposing compressive forces to) the sloped surfaces 1208-1210 of the expanding dowel 912, thereby causing the expansion slots 1206-1207 to widen and cause the expanding dowel 912 to expand outward to touch the inner surface of the opening 920 in the flange portion 916. Further tightening of the nut 914 on the bolt 906 causes further outward expansion pressure on the expanding dowel 912, thereby creating a tight fit between the expanding dowel 912 and the opening 920. Once the nut 914 is tight, the bolt 906 is securely attached in the center of the opening 920, and the mounting base 902 is securely attached to the top surface of the flange portion 216.

Figure 14:
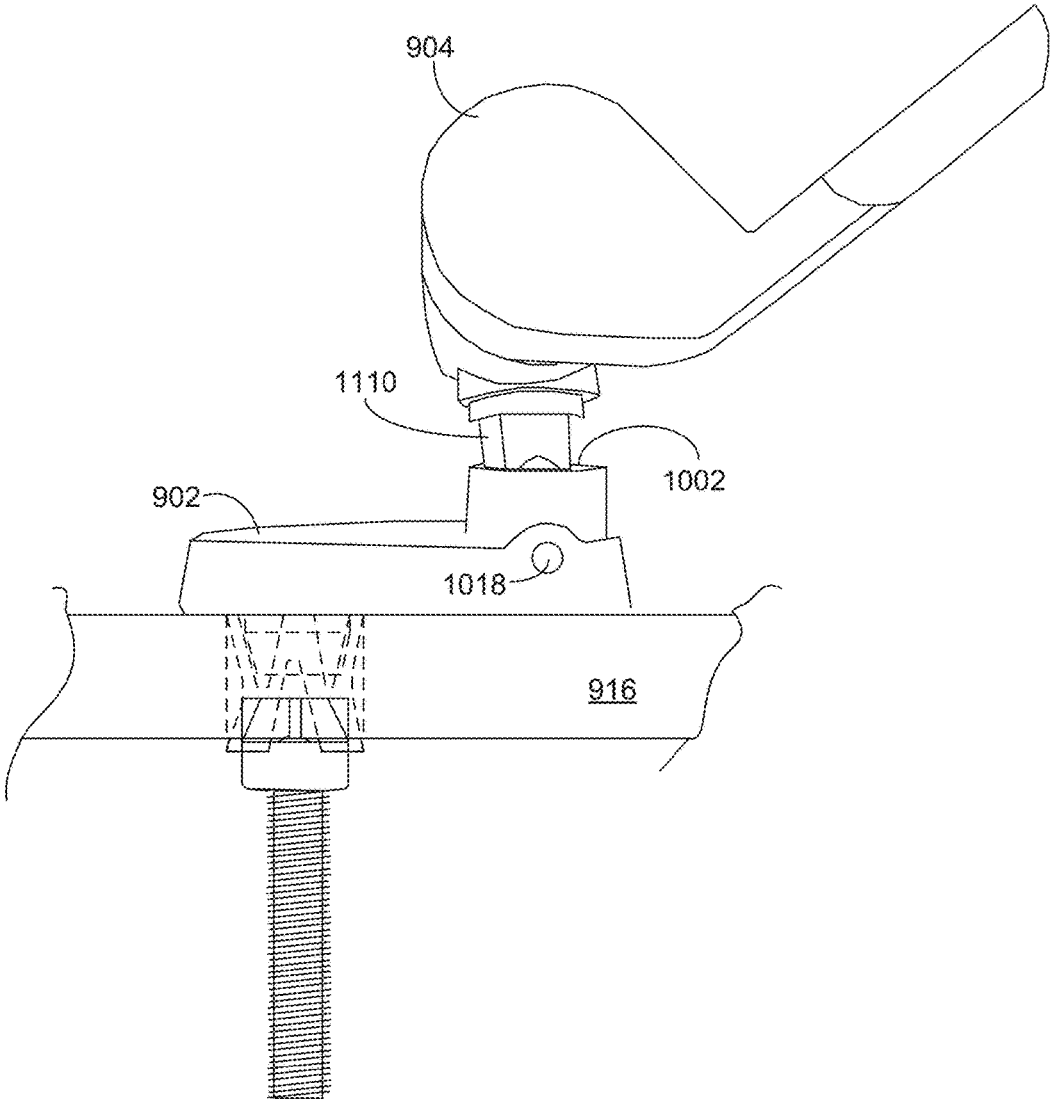
FIG. 14 illustrates connection of a toilet seat and lid to an attached mounting base according to this disclosure.

Then, as shown in FIG. 14, to attach the toilet seat and lid, the square stem 1110 of the hinge leaf assembly 904 (to which the toilet seat and lid are attached) can be inserted into the mounting hole 1002, and an adjustable tensioning device 410 can be advanced in each threaded opening 1018 until it contacts and tightens against the circular recesses 1112 of the stem 1110. This securely locks the toilet lid and seat to the toilet. A simple loosening of each adjustable tensioning device 410 allows the hinge leaf assembly 904 (with attached toilet lid and seat) to be lifted up and removed from the mounting base 902.

Although FIGS. 9 through 14 depict various details of one example of a hinge assembly 900, various changes may be made to FIGS. 9 through 14. For example, while shown comprised of certain components, the hinge assembly 900 may include more or fewer components. Components shown in FIGS. 9 through 14 may be removed, repeated, or arranged in a different order. Components may have dimensions other than those shown or described. Other components, composed of the same or different materials, may be added to the hinge assembly 900.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the applicants to refer to structures known to those skilled in the relevant art and is not intended to invoke 35 U.S.C. § 112(f).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A hinge assembly for a toilet seat, comprising:

a mounting base comprising a square or star-shaped mounting hole;

a hinge leaf assembly comprising a square or star-shaped stem configured to fit in the square or star-shaped mounting hole of the mounting base, wherein the hinge leaf assembly and the mounting base are configured to be separated or attached to each other, wherein the hinge leaf assembly further comprises hinge leaves configured to attach to the toilet seat and a toilet lid;

a threaded bolt configured to attach the mounting base to a flange portion of a toilet bowl, the bolt having a bolt head at one end;

a threaded nut having a sloped surface and configured to screw onto the bolt;

a washer having a sloped surface and configured to surround the bolt between the bolt head and the nut; and an expanding dowel configured to expand outward and configured to surround the bolt between the washer and the nut, the expanding dowel comprising (i) a plurality of first expansion slots that extend partially along a length of the expanding dowel from a first end of the expanding dowel, and (ii) a plurality of second expansion slots that extend partially along the length of the expanding dowel from a second end of the expanding dowel, wherein the first expansion slots and the second expansion slots are interleaved around a circumference of the expanding dowel.

2. The hinge assembly of claim 1, wherein the sloped surfaces of the washer and the nut are configured to contact sloped surfaces on opposite ends of the expanding dowel.

3. The hinge assembly of claim 1, wherein when the hinge assembly is installed on the flange portion of the toilet bowl, the nut and washer are configured to squeeze the expanding dowel, thereby causing the expanding dowel to expand and tightly fill an opening in the flange portion of the toilet bowl.

4. The hinge assembly of claim 1, wherein the nut further comprises a plurality of fins projecting radially from the sloped surface, each fin configured to align with a corresponding one of the first or second expansion slots.

5. A toilet seat assembly comprising:

a toilet seat;

a toilet lid; and one or more hinge assemblies pivotally coupling the toilet seat and toilet lid, each hinge assembly comprising:

a mounting base comprising a square or star-shaped mounting hole;

a hinge leaf assembly comprising a square or star-shaped stem configured to fit in the square or star-shaped mounting hole of the mounting base, wherein the hinge leaf assembly and the mounting base are configured to be separated or attached to each other, wherein the hinge leaf assembly further comprises hinge leaves configured to attach to the toilet seat and the toilet lid;

a threaded bolt configured to attach the mounting base to a flange portion of a toilet bowl, the bolt having a bolt head at one end;

a threaded nut having a sloped surface and configured to screw onto the bolt;

a washer having a sloped surface and configured to surround the bolt between the bolt head and the nut; and an expanding dowel configured to expand outward and configured to surround the bolt between the washer and the nut, the expanding dowel comprising (i) a plurality of first expansion slots that extend partially along a length of the expanding dowel from a first end of the expanding dowel, and (ii) a plurality of second expansion slots that extend partially along the length of the expanding dowel from a second end of the expanding dowel, wherein the first expansion slots and the second expansion slots are interleaved around a circumference of the expanding dowel.

6. The toilet seat assembly of claim 5, wherein the sloped surfaces of the washer and the nut are configured to contact sloped surfaces on opposite ends of the expanding dowel.

7. The toilet seat assembly of claim 5, wherein when the toilet seat assembly is installed on the flange portion of the toilet bowl, the nut and washer are configured to squeeze the expanding dowel, thereby causing the expanding dowel to expand and tightly fill an opening in the flange portion of the toilet bowl.

8. The toilet seat assembly of claim 5, wherein the nut further comprises a plurality of fins projecting radially from the sloped surface, each fin configured to align with a corresponding one of the first or second expansion slots.

9. The hinge assembly of claim 1, wherein the mounting base comprises one or more threaded openings that extend from an edge of the mounting base to an inner surface of the mounting base forming the square or star-shaped mounting hole.

10. The hinge assembly of claim 9, further comprising:

an adjustable tensioning device configured to screw into each of the one or more threaded openings, the adjustable tensioning device comprising a tip, a spring, and a set screw in a coaxial arrangement.

11. The hinge assembly of claim 1, wherein the mounting base further comprises a second hole configured to receive the threaded bolt to attach the mounting base to the flange portion of the toilet bowl.

12. The hinge assembly of claim 11, wherein the second hole comprises a recess configured to receive the bolt head.

13. The hinge assembly of claim 11, further comprising:

a cap configured to cover most of the mounting base, the cap comprising an opening through which a top portion of the mounting hole can extend when the cap is disposed over the mounting base.

14. The hinge assembly of claim 1, wherein the bolt head comprises a slot configured to receive a tool for turning the bolt.

15. The toilet seat assembly of claim 5, wherein the mounting base comprises one or more threaded openings that extend from an edge of the mounting base to an inner surface of the mounting base forming the square or star-shaped mounting hole.

16. The toilet seat assembly of claim 15, further comprising:

an adjustable tensioning device configured to screw into each of the one or more threaded openings, the adjustable tensioning device comprising a tip, a spring, and a set screw in a coaxial arrangement.

17. The toilet seat assembly of claim 5, wherein the mounting base further comprises a second hole configured to receive the threaded bolt to attach the mounting base to the flange portion of the toilet bowl.

18. The toilet seat assembly of claim 17, wherein the second hole comprises a recess configured to receive the bolt head.

19. The toilet seat assembly of claim 17, further comprising:

a cap configured to cover most of the mounting base, the cap comprising an opening through which a top portion of the mounting hole can extend when the cap is disposed over the mounting base.

20. The toilet seat assembly of claim 5, wherein the bolt head comprises a slot configured to receive a tool for turning the bolt.

* * * * *